US007980884B2

(12) United States Patent
Kondo et al.

(10) Patent No.: US 7,980,884 B2
(45) Date of Patent: Jul. 19, 2011

(54) STRUCTURE FOR CONNECTING FLEXIBLE SUBSTRATE AND TERMINAL FITTING

(75) Inventors: Masahiro Kondo, Sakura (JP); Takuya Osaki, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 12/245,488

(22) Filed: Oct. 3, 2008

(65) Prior Publication Data

US 2009/0098752 A1 Apr. 16, 2009

(30) Foreign Application Priority Data

Oct. 5, 2007 (JP) ..... 2007-261830
Oct. 5, 2007 (JP) ..... 2007-261831

(51) Int. Cl.
*H01R 4/24* (2006.01)

(52) U.S. Cl. ..... 439/422

(58) Field of Classification Search ..... 439/422, 439/423, 421, 877
See application file for complete search history.

(56) References Cited

U.S. PATENT DOCUMENTS 5,450,664 A * 9/1995 Babow et al. ..... 29/866
2006/0166547 A1 * 7/2006 Deutmarg et al. ..... 439/422

FOREIGN PATENT DOCUMENTS

EP 0 286 422 A2 10/1988
EP 0 926 764 A2 6/1999
JP 3271925 A 10/1998
JP 2001-52769 A 2/2001
JP 2006-172751 A 6/2006

* cited by examiner

*Primary Examiner* — Phuong K Dinh
(74) *Attorney, Agent, or Firm* — Sughrue Mion, PLLC

(57) ABSTRACT

A structure for connecting a flexible substrate and a terminal fitting is provided, the terminal fitting including: an upper plate; a lower plate; and a barrel which is formed in an upstanding manner on the lower plate, and is inserted into a hole formed in the flexible substrate; the flexible substrate being held between the upper plate and the lower plate by bending the barrel inserted to the hole, wherein a projection is formed in each of the upper plate and the lower plate, and the flexible substrate is held between the projections.

28 Claims, 17 Drawing Sheets

STRUCTURE FOR CONNECTING FLEXIBLE SUBSTRATE AND TERMINAL FITTING

CROSS-REFERENCE TO RELATED APPLICATION

This application is based on and claims priority from Japanese Patent Applications No. 2007-030385, 2007-261830 and 2007-261831, filed on Feb. 9, 2007, Oct. 5, 2007, and Oct. 5, 2007, respectively, in the Japanese Patent Office, the disclosure of which is incorporated herein in its entirety by reference.

BACKGROUND OF THE INVENTION

1. Field of the Invention

Apparatuses consistent with the present invention relate to a structure for connecting a flexible substrate, such as a membrane board or a flexible printed circuit board (FPC), and a terminal fitting.

2. Description of the Related Art

For a related art connection structure of this kind, as shown in FIG. I, a connection structure is configured so that: barrels 51 are formed in an upstanding manner on a lower plate of each of terminal fittings 50 which has an upper plate and a lower plate; holes 52, in which the barrels 51 in the lower plate of the terminal fittings are inserted, are formed on a portion of a circuit board 53; a reinforcing plate 54 having similar holes is disposed on the hole-formed portion of the board 53; the upper plate of the terminal fittings are lifted to insert the barrels 51 formed on the lower plate of the terminal fitting into the holes 52 formed in the circuit board 53 and the upper plate is retuned to its original position, thereby sandwiching the board 53 between the lower plate and the upper plate; the barrels 51 are bent to secure the upper plate; and the print side of the circuit board 53 and the lower plate are in contact with each other. According to this related art example, it is possible to improve workability, prevent a circuit surface from being damaged and enhance connection reliability.

For another related art example, as shown in FIG. 2, a connection structure is configured so that: each of terminals 61 is provided at one end in the longitudinal direction of a base 60; a flexible printed circuit (FPC) 62 is mounted on a mounting surface of the base 60; and the FPC 62 is pressure-bonded and secured by the outer peripheral surfaces of barrels 63 and the mounting surface, the barrels 63 extend from both sides of the base 60, and are substantially perpendicular to the longitudinal direction of the base 60, the barrels are also provided facing the mounting surface and being curved inward to form a cylindrical shape. With this configuration, the outer peripheral surfaces of the barrels 63 are in surface-contact with the FPC 62 and concentrative stress applied to the FPC 62 is thereby relaxed, making it possible to prevent the FPC 62 from being damaged. Even though the material thickness of the FPC 62 is decreased as a result of the relaxation of stress on the FPC 62 due to secular changes, an elastic force can be applied to the FPC 62 by the barrels 63, making it possible to maintain stable connection to the FPC 62 over a long period of time. These barrels 63 have a small spring constant, and accordingly, it can reduce an elastic pressure decrease caused by the decease of the material thickness of the FPC 62.

For a still another related art example, as shown in FIG. 3, a connection structure includes: a pair of metal plates 71 and 72 holding a membrane circuit 70 therebetween; two connection members 73 and 74 connecting, in a fixed manner, the pair of metal plates 71 and 72 with the membrane circuit 70 interposed therebetween; and at least one protrusion 75 formed on at least one of the pair of metal plates 71 and 72 and located in between the two connection members 73 and 74 in such a manner that it protrudes toward the membrane circuit 70.

Since the related art example shown in FIG. 1 has a structure in which protrusions are provided only to either the upper plate or the lower plate of each of the terminal fittings to make the circuit of the flexible substrate and the terminal fittings in contact with each other, it lacks connection reliability when surfaces of the terminal fittings with no protrusions and the circuit side are disposed to be contact with each other, and accordingly, it is necessary to turn the terminal fittings such that the opposite surface with protrusions and the circuit side are disposed to be in contact with each other, to fit to the circuit surface of the flexible substrate.

The related art example shown in FIG. 2 has a disadvantage in that it is difficult to maintain the balance of the contact force between the upper portion and the lower portion of the terminal fittings where a structure in which the upper portion is provided with protrusions and the lower portion is provided with holes is employed, because the contact point shape differs between the upper and lower portions. Where the balance cannot be maintained, an incorrect behavior may occur when an environmental test or the like is conducted.

The related art example shown in FIG. 3, the protrusion of the terminal fitting and the circuit surface of the flexible substrate are made in contact with each other after they are matched with each other, which results in poor workability. Also, with this related art example structure, it is difficult to employ multipolarity.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

Accordingly, an aspect of the present invention is to provide a structure for connecting a flexible substrate and a terminal fitting, the structure reliably placing a circuit of the flexible substrate and a terminal in contact with each other and being conductive with each other regardless of whether the flexible substrate has the circuit on the upper or lower side; providing the two-sided connection using a terminal with a related art shape as it is; making it easier to keep the balance between the contact forces of the upper and lower portions and thereby improving connection reliability; and improving workability because terminal pressure-bonding work can be performed without paying attention to the side of the flexible substrate having a circuit, which results in a substantial reduction of the number of man-hours.

According to an aspect of the present invention, there is provided a structure for connecting a flexible substrate and a terminal fitting, the terminal fitting comprising: an upper plate; a lower plate, and a barrel which is formed in an upstanding manner on the lower plate, wherein the barrel which is formed on the lower plate is inserted into a hole, which is formed in the flexible substrate, the flexible substrate is held between the upper plate and the lower plate by bending the barrel inserted into the hole, and wherein: a projection is formed in each of the upper plate and the lower plate; and the flexible substrate is held between the projection formed in the upper plate and the projection formed in the lower plate.

According to another aspect of the present invention, there is provided a structure for connecting a flexible substrate and a terminal fitting, the terminal fitting comprising: an upper plate; a lower plate, a barrel which is formed in an upstanding manner on the lower plate; a projection in one of the upper plate and the lower plate, the projection being elongated in a width direction of the plate, and projecting longer than an adjacent projection elongated in a longitudinal direction of the plate; and a projection in the other plate, the projection being elongated in a longitudinal direction of the other plate, and projecting longer than an adjacent projection elongated in a width direction of the other plate; wherein: the barrel on the lower plate is inserted into a hole being formed in the flexible substrate, the flexible substrate is held between the upper plate and the lower plate by bending the barrel inserted to the hole, and the flexible substrate is held between projections formed in each of the upper plate and the lower plate; a recess is formed at a back side of each of the projections; a surface of each of the projections is formed to have an elongated flat surface; and when the projections which each project longer are brought into contact with the flexible substrate by pressure, an intermediate portion between two long sides of the projection elongated in the width direction dents, thereby the two long sides coming into pressure-contact with the flexible substrate as edges.

According to still another aspect of the present invention; there is provided a structure for connecting a flexible substrate and a terminal fitting, the terminal fitting comprising: an upper plate; a lower plate, a barrel being formed in an upstanding manner on the lower plate, which is inserted into a hole formed in the flexible substrate, a projection in one of the upper plate and the lower plate, the projection being elongated in a width direction of the plate, projects longer than an adjacent projection elongated in a longitudinal direction of the plate; and a projection in the other plate, the projection being elongated in a longitudinal direction of the other plate, projects longer than an adjacent projection elongated in a width direction of the other plate; wherein: the flexible substrate being held between the upper plate and the lower plate by bending the barrel inserted to the hole; the flexible substrate is held between projections formed in the upper plate and the lower plate; a recess is formed at a back side of each of the projections; when the projections which each project longer are brought into contact with the flexible substrate by pressure, a surface of the projection elongated in the width direction comes into pressure-contact with the flexible substrate, in a shape rounded in an circular arc-like manner; and a surface of the facing projection elongated in the longitudinal direction is formed to have a flat surface.

DETAILED DESCRIPTION OF THE INVENTION

Figure 1:
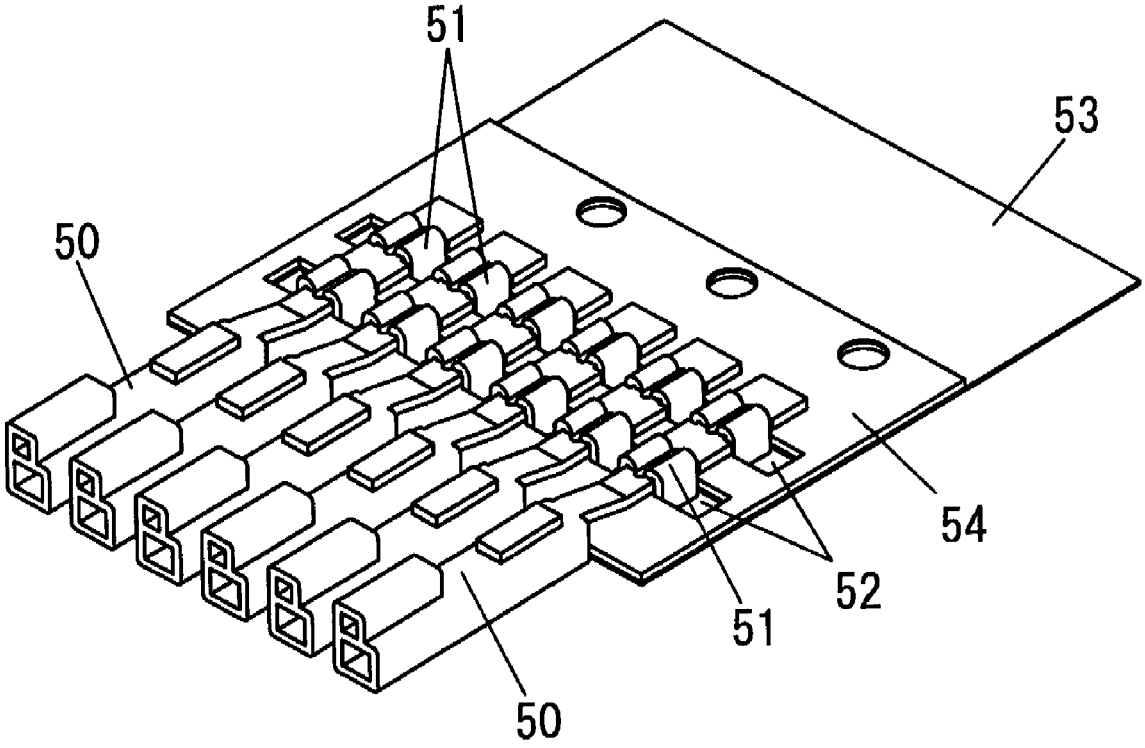
FIG. 1 (PRIOR ART)
FIG. 1 is a perspective view of a related art example.
Figure 2:
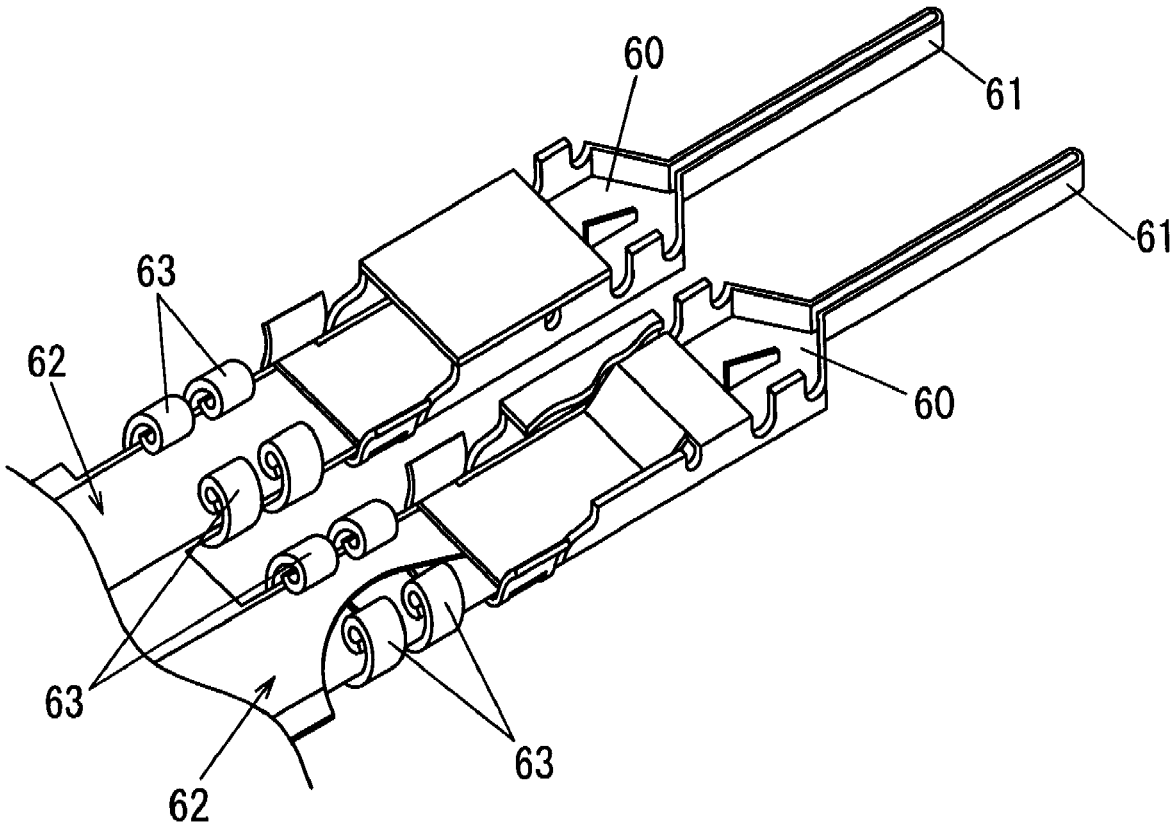
FIG. 2 (PRIOR ART)
FIG. 2 is a perspective view of another related art example.
Figure 3:
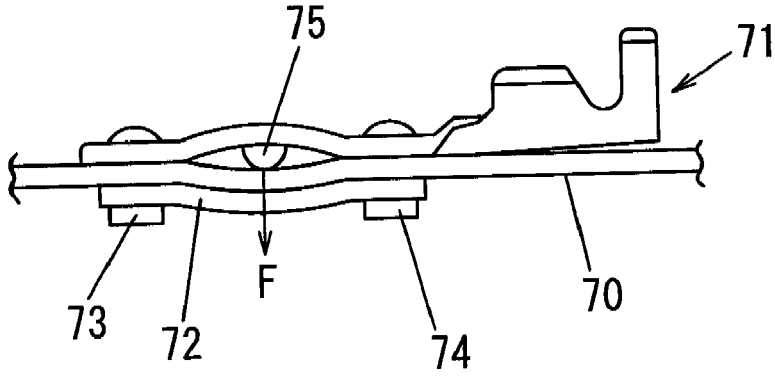
FIG. 3 (PRIOR ART)
FIG. 3 is a perspective view of a still another related art example.
Figure 4:
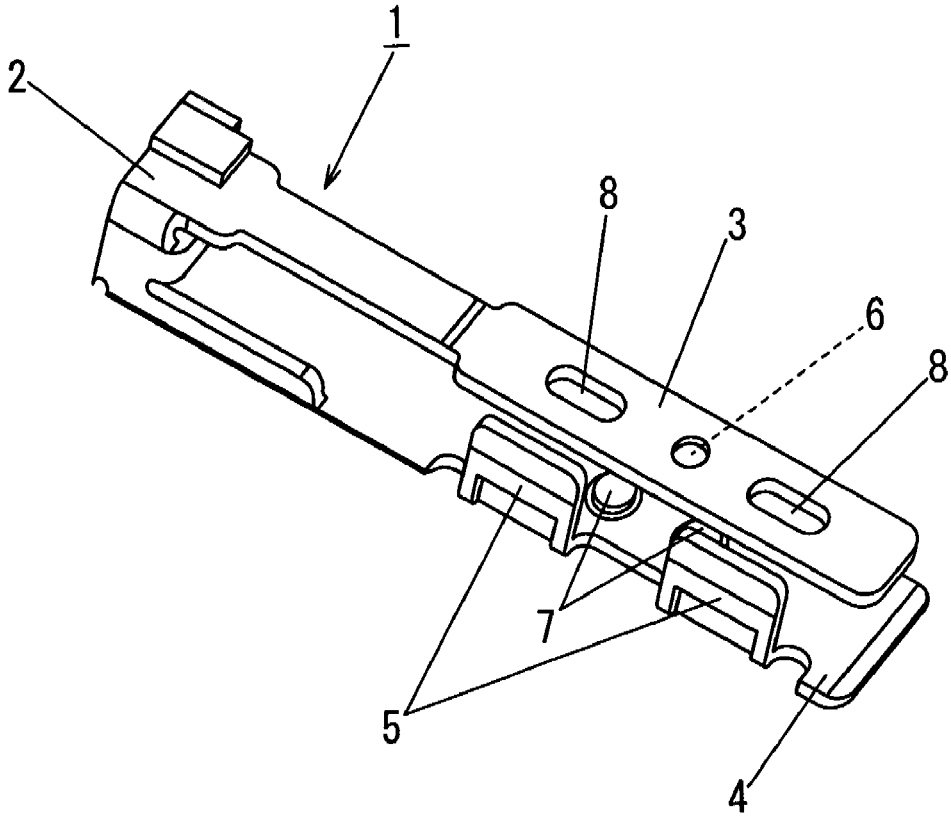
FIG. 4 is a perspective view of a terminal fitting according to a first exemplary embodiment of the present invention.
Figure 5:
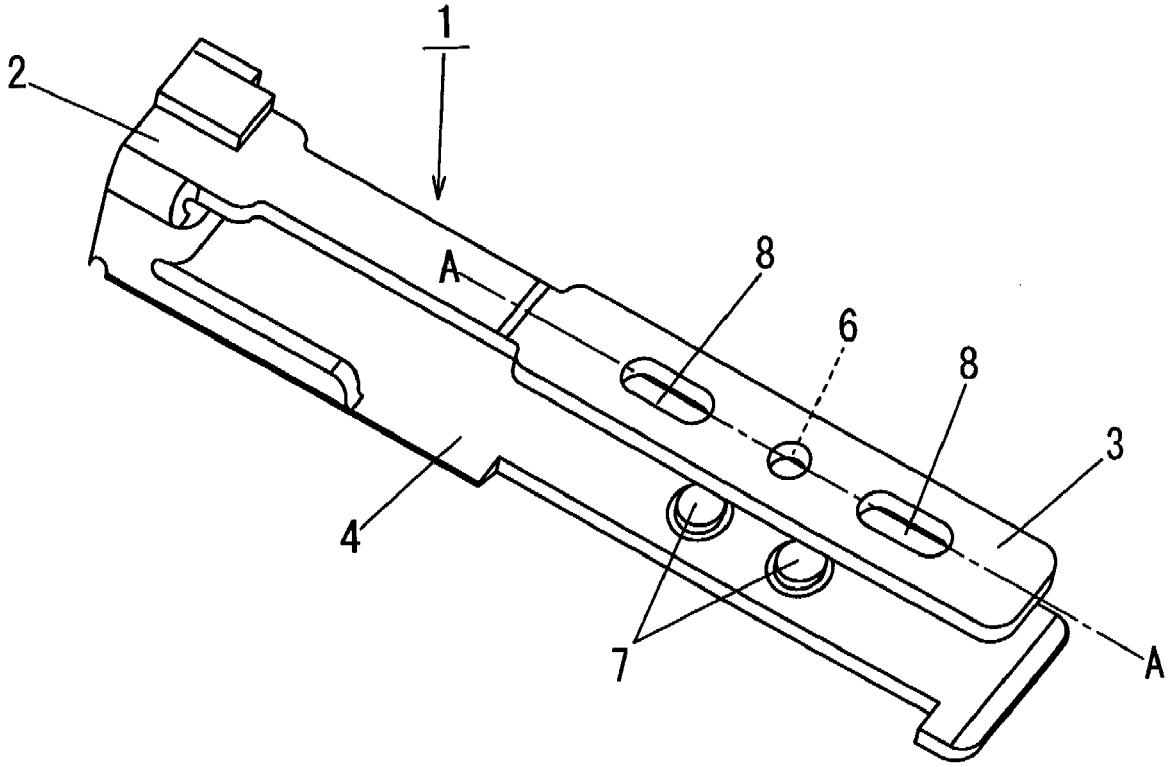
FIG. 5 is a perspective view of the terminal fitting shown in FIG. 4 with barrels omitted.
Figure 6:
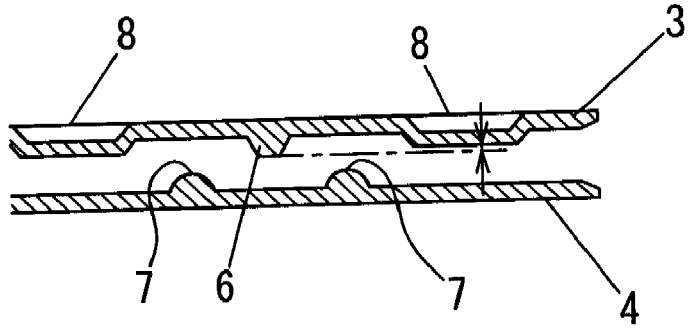
FIG. 6 is a cross-sectional view taken from line A-A of FIG. 5.

FIGS. 4 to 6 each illustrate a terminal fitting 1 according to a first exemplary embodiment, and in the overall perspective view in FIG. 4, an upper plate 3 and a lower plate 4, which are coupled to a tube 2 to which a male terminal or an electric wire is inserted and secured, extend in parallel to each other, barrels 5 are formed in an upstanding manner on the lower plate 4, projections 6 and 7 are formed on the mutually-facing inner surfaces of the upper plate 3 and the lower plate 4, respectively. In FIG. 1, two barrels 5 are formed, two projections 7 of the lower plate 4 are formed, and one projection 6 of the upper plate 3 is formed in such a manner that it is positioned between the two projections 7. Also, in order to provide this projection 6-formed portion of the upper plate 3 with a spring property, dents 8 are formed on both sides of the projection 6. FIG. 6 is a cross-sectional view taken from line A-A in the terminal fitting 1 with the barrels 5 omitted shown in FIG. 5, and shows that the projection 6 is formed in such a manner that it projects a bit beyond the lower surfaces of the two dents 8 of the upper plate 3.

Figure 7:
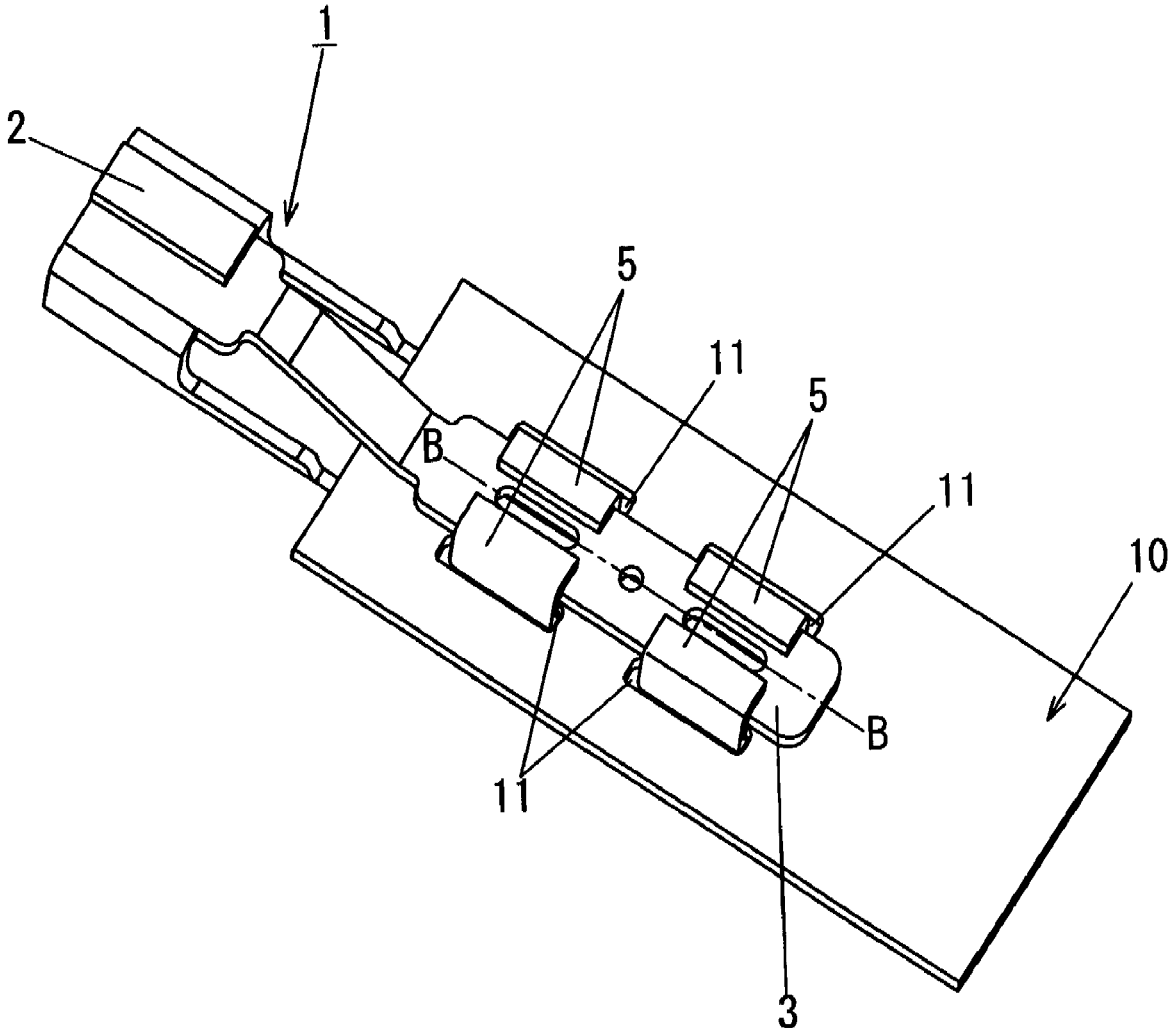
FIG. 7 is a perspective diagram showing a state of connection.

FIG. 7 shows a state in which the terminal fitting 1 is connected to a flexible substrate 10, such as an FPC, the barrels 5 formed on the lower plate 4 are inserted to holes 11 formed in the flexible substrate 10, and these barrels 5 are bent inward to draw the upper plate 3 toward the lower plate 4 side in such a manner that they hold the upper plate 3.

Figure 8:
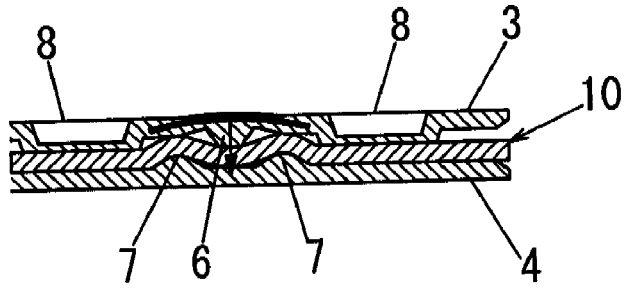
FIG. 8 is a cross-sectional view taken from line B-B of FIG. 7.

FIG. 8 is a cross-sectional view taken from line B-B of FIG. 7. When the flexible substrate 10 is held between the upper plate 3 and the lower plate 4, the flexible substrate 10 is deformed into a wave shape by means of the projections 6 and 7, and the bottoms of the dents 8 are strongly pressed against the flexible substrate 10. As shown in FIG. 6, the upper plate 3 bends upward as a result of the spring property of the projection 6 portion of the upper plate 3 being exerted because of the level difference between the projection 6 and the bottoms of the dents 8. As a result of the bending shown in FIG. 8, the pressure imposed on the flexible substrate 10 by means of the projection 6 is increased, providing reliable holding.

Figure 9:
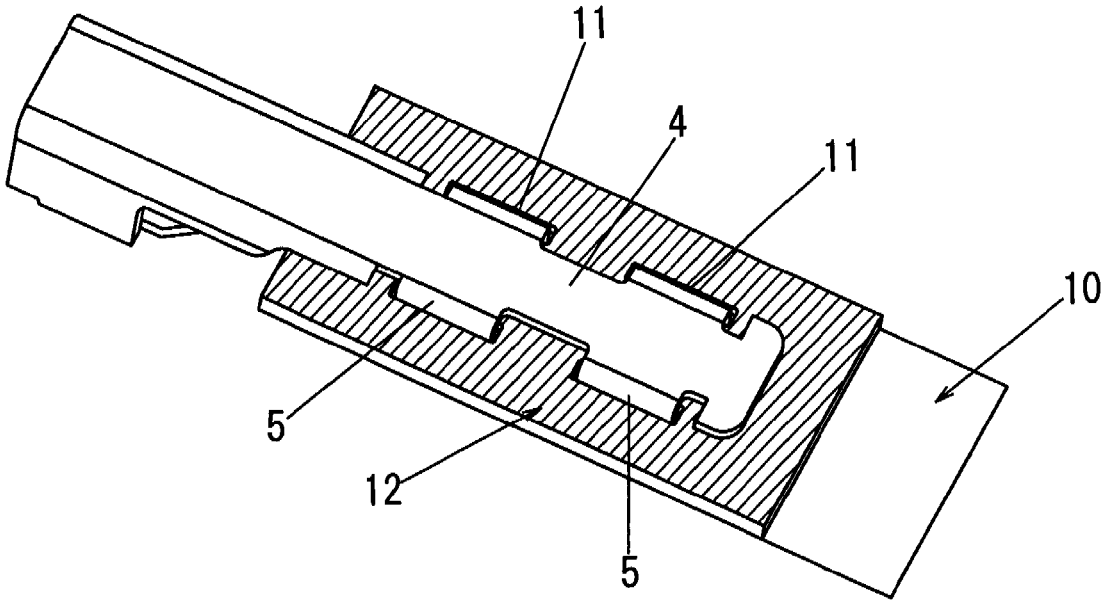
FIG. 9 is a perspective view of a second exemplary embodiment viewed from the back surface side.
Figure 10:
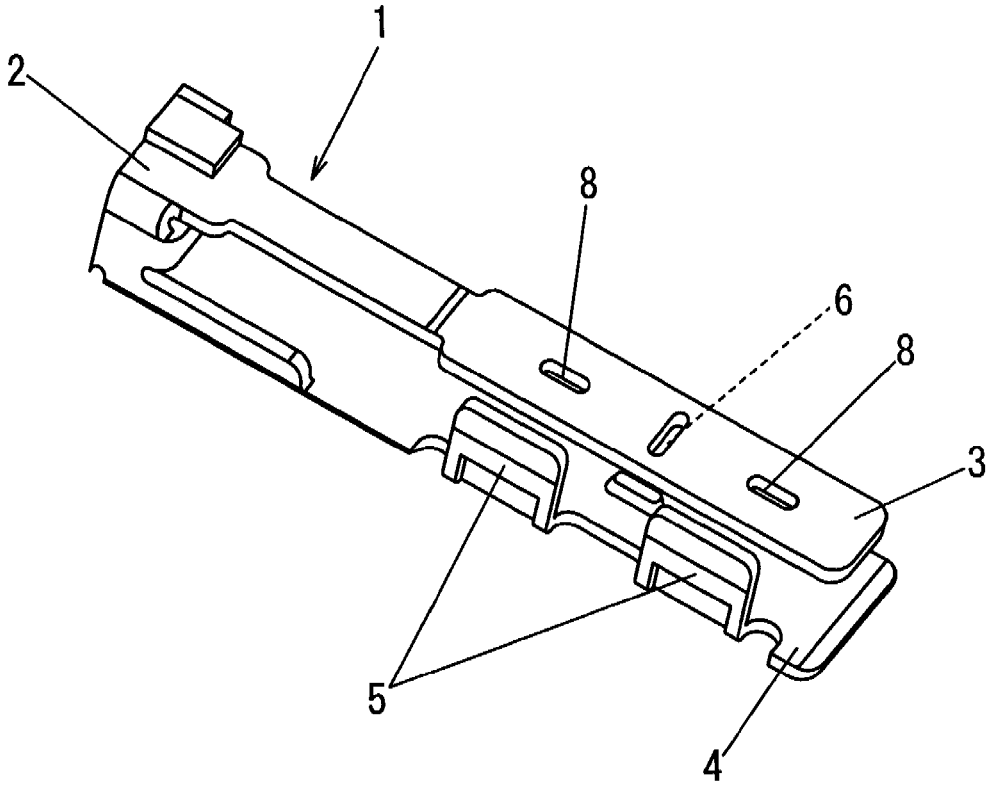
FIG. 10 is a perspective view of a terminal fitting according to a third exemplary embodiment.
Figure 11:
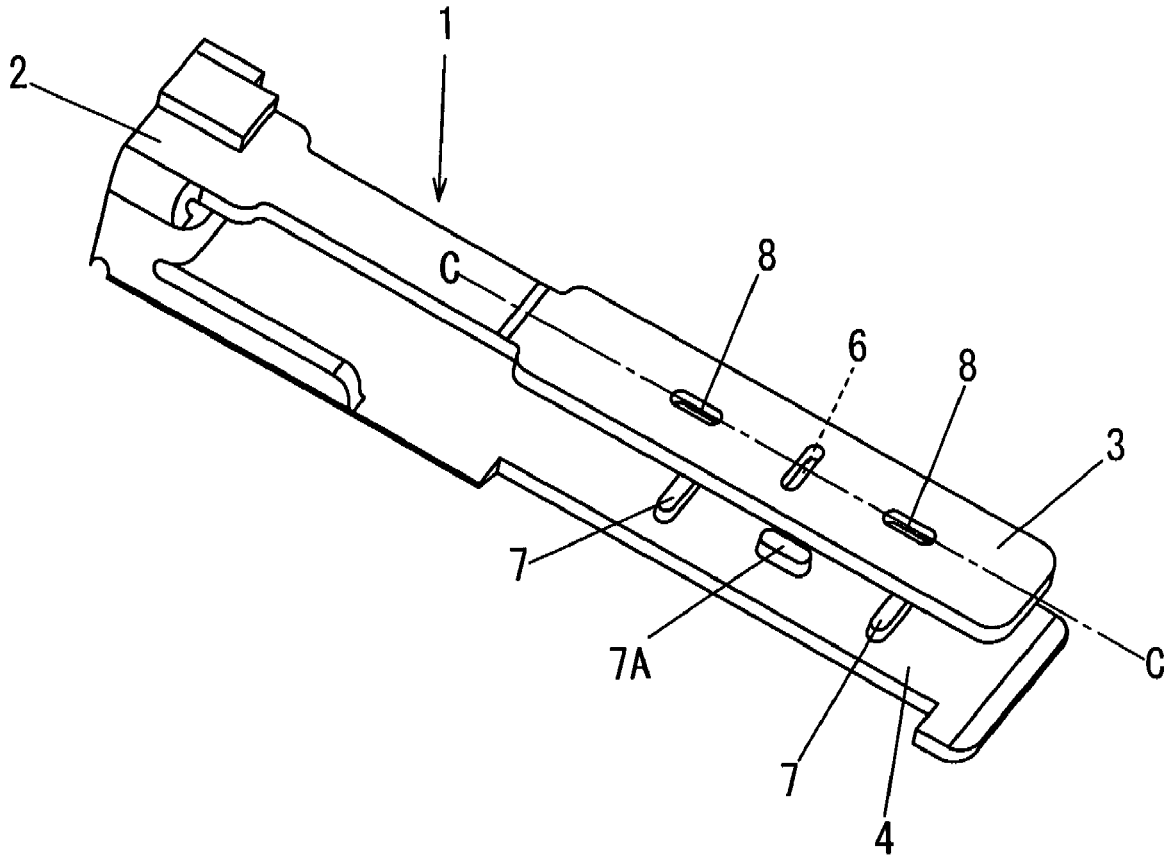
FIG. 11 is a perspective view of the terminal fitting shown in FIG. 10 with the barrels omitted.
Figure 12:
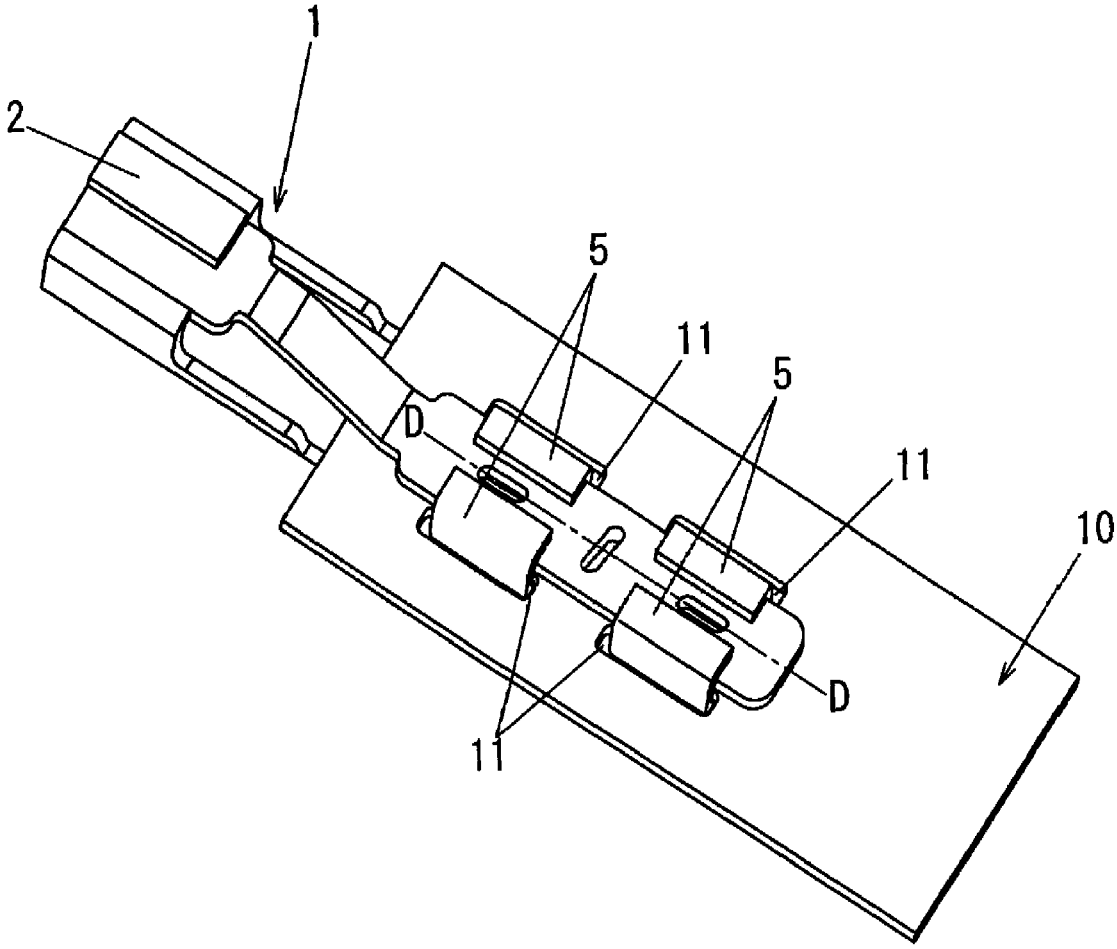
FIG. 12 is a perspective diagram showing a state of connection.
Figure 13:
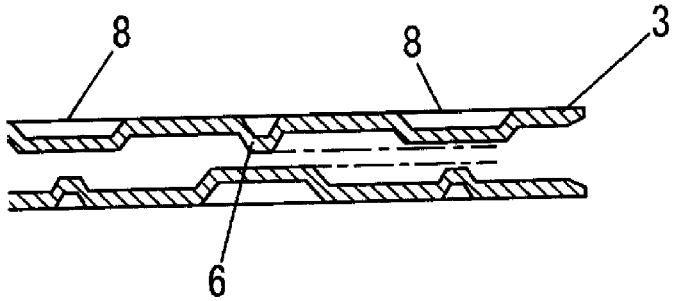
FIG. 13 is a cross-sectional view taken from line C-C of FIG. 11.
Figure 14:
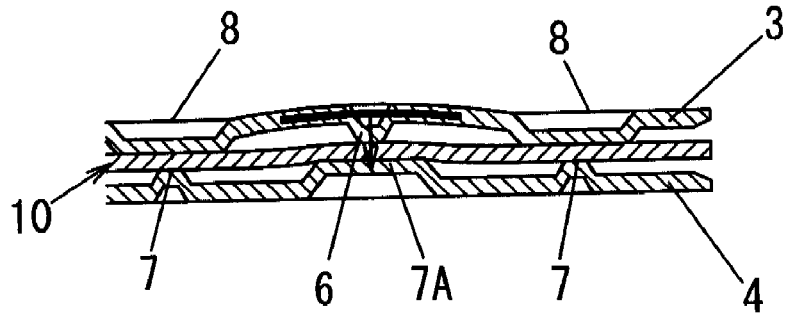
FIG. 14 is a cross-sectional view taken from line D-D of FIG. 12.

A second exemplary embodiment, which is shown in FIG. 9, provides an example in which a hard reinforcing plate 12 is provided to a flexible substrate 10 (this is effective especially for an FPC) to connect the flexible substrate 10 and a terminal fitting 1 at the portion where this reinforcing plate 12 is provided. The portions of the reinforcing plate 12 corresponding to two projections 7 formed on a lower plate 4 are provided with holes through which the projections 7 pass.

Three projections 6 and 7 are formed in the upper and lower plates 3 and 4: a projection 6 is positioned at the center of two projections 7, forming a "W-shape" in cross section, similar to FIG. 8. With such W-shape connection structure, it is possible to reliably make the flexible substrate 10 (including a membrane circuit) in contact with and conductive to the terminal fitting 1 regardless of whether the flexible substrate 10 has a circuit on the upper or lower side.

FIGS. 10 to 14 show a third exemplary embodiment that makes it possible to more firmly hold a flexible substrate 10, strengthening the connection. In other words, the distance between two projections 7 formed on a lower plate 4 is made to be longer than those of the aforementioned embodiments and a center projection 7A, which is long in the lengthwise direction of the lower plate 4, is formed at the portion of the lower plate 4 facing a projection 6 of an upper plate 3 in between the projections 7. The other projections 6 and 7 are long in the widthwise direction of the upper and lower plates 3 and 4, and the projection 6 and the center projection 7A form a cross shape when they are overlapped with each other. Also, the projections 7 face dents 8, and the projections 7 facing dents 8 form a cross shape when they are overlapped with each other.

Figure 15:
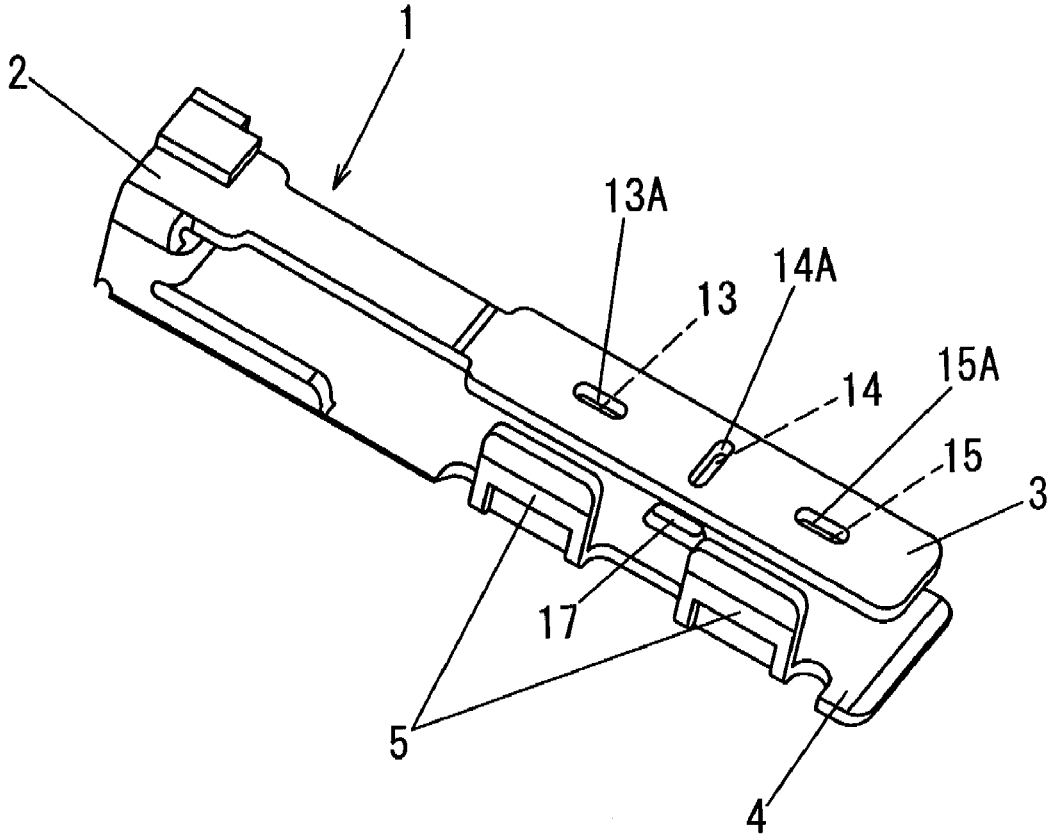
FIG. 15 is a perspective view of a terminal fitting according to a fourth exemplary embodiment.
Figure 16:
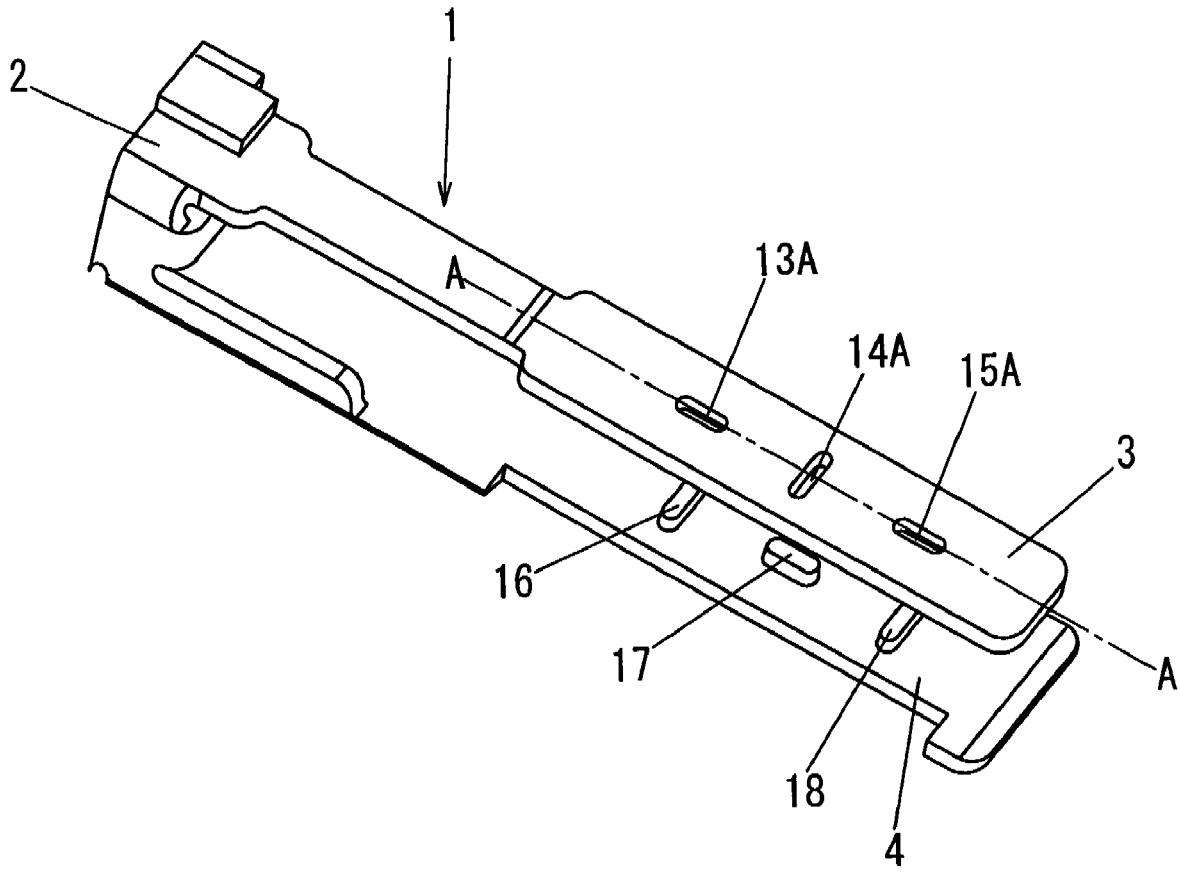
FIG. 16 is a perspective view of the terminal fitting shown in FIG. 15 with the barrels omitted.

A terminal fitting 1, which is shown in FIGS. 15 and 16, according to a fourth exemplary embodiment, includes an upper plate 3 and a lower plate 4, which are coupled to a tube 2 to which a male terminal or an electric wire is inserted and secured, extend in parallel with each other. Barrels 5 are formed in an upstanding manner on the lower plate 4, and projections 13 to 18 are respectively formed on the mutually-facing inner surfaces of the upper plate 3 and the lower plate 4. As shown, two pairs of barrels 5, each pair consisting of two, i.e., right and left barrels, are formed. The projections 13 to 18 consist of: two (projections 13 and 15) with a shape elongated along the longitudinal direction of the upper plate 3 and one (projection 14) with a shape elongated along the width direction disposed between these projections in the upper plate 3; and two (projections 16 and 18) with a shape elongated along the width direction of the lower plate 4 and one (projection 17) with a shape elongated along the longitudinal direction disposed between these projections in the lower plate 4. Then, the surfaces of these projections 13 to 18 are formed to have elongated flat surfaces, and on the back sides thereof, recesses 13A to 18A are formed. These recesses 13A to 18A are formed at positions where metal plate materials are struck by means of press-molding and the projections 13 to 18 are formed at the portions that have protruded as a result of the pressing.

Figure 17:
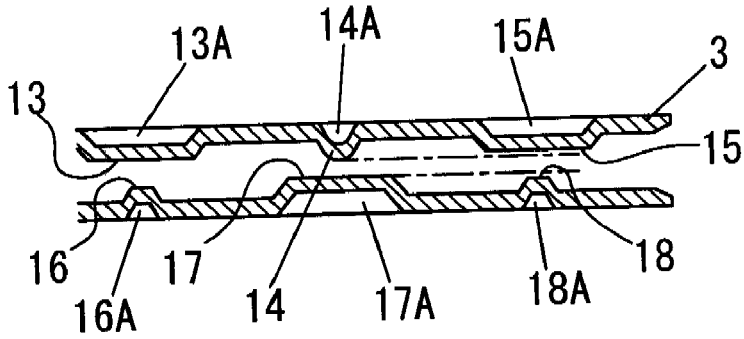
FIG. 17 is a cross-sectional view taken from line A-A of FIG. 16.

The projection 14, which is positioned in the middle of the upper plate 3 and elongated in the widthwise direction of the upper plate 3, as shown in FIG. 17, projects longer than the projections 13 and 15, which are adjacent to the projection 14 and elongated in the longitudinal direction (in FIG. 17, projection 14 projects longer downward), and the projection 17, which is positioned in the middle of the lower plate 4 and elongated in the longitudinal direction of the lower plate 4, projects longer than the projections 16 and 18, which are adjacent to the projection 17 and elongated in the widthwise direction (in FIG. 17, it projects longer upward).

Figure 18:
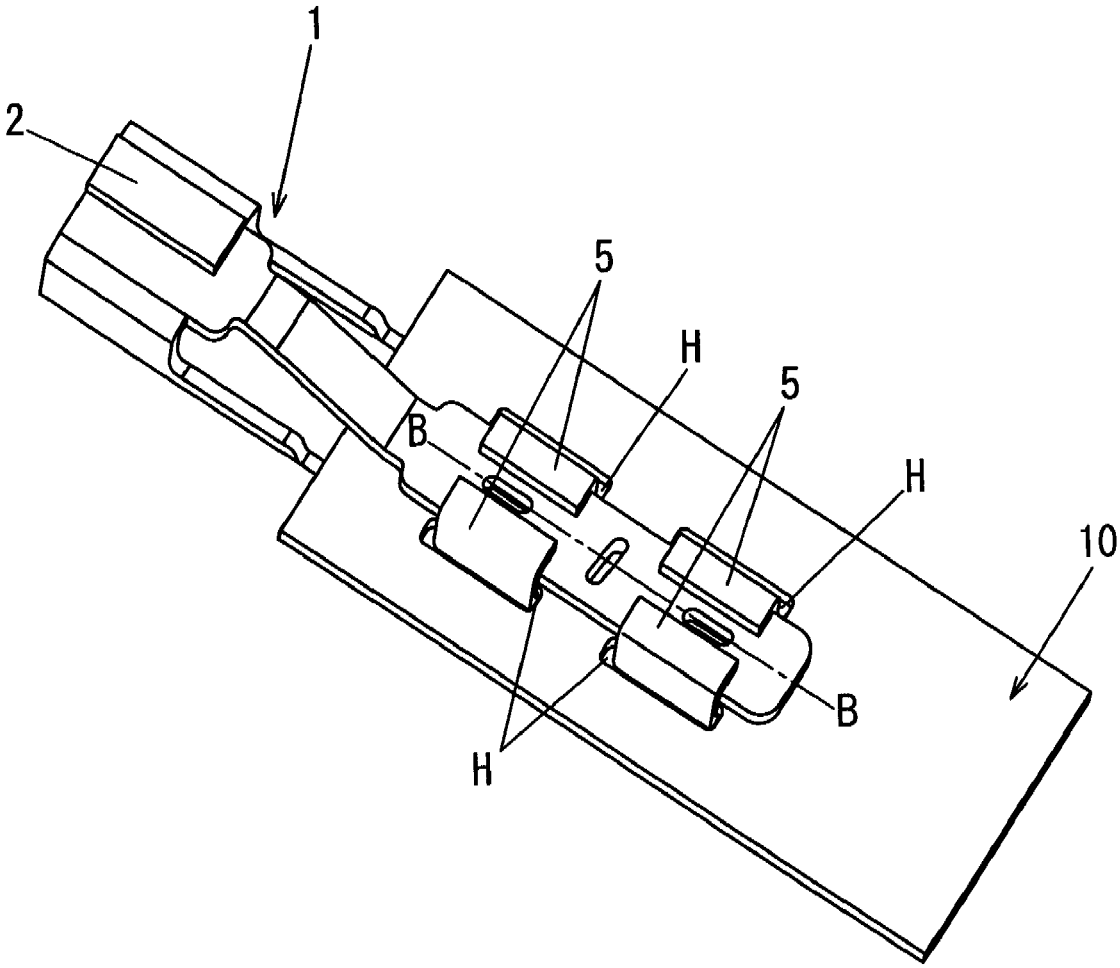
FIG. 18 is a perspective diagram showing a state of connection.

FIG. 18 shows a state in which the terminal fitting 1 is connected to a flexible substrate 10 such as an FPC, the barrels 5 formed on the lower plate 4 are inserted to holes H formed in the flexible substrate 10, and these barrels 5 are bent inward to draw the upper plate 3 toward the lower plate 4 side in such a manner that they hold the upper plate 3.

Figure 19:
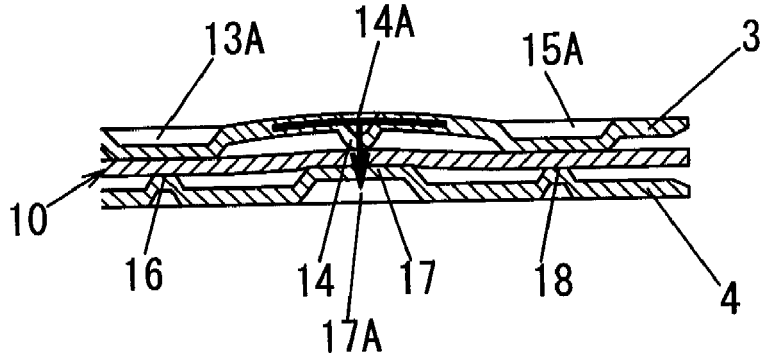
FIG. 19 is a cross-sectional view taken from line B-B of FIG. 18.

FIG. 19 is a cross-sectional view taken from line B-B of FIG. 18, and when the flexible substrate 10 is held between the upper plate 3 and the lower plate 4, the flexible substrate 10 is deformed into a wave shape by means of the projections 14 and 17 and the bottoms of the recesses 13A and 15A are strongly pressed against the flexible substrate 10. As shown in FIG. 19, the upper plate 3 bends upward as a result of the spring property of the projection 14 portion of the upper plate 3 being exerted because of the level difference between projection 14 and projections 13 and 15. As a result of the bending shown in FIG. 19, the pressure imposed on the flexible substrate 10 by means of the projection 14 is increased, providing reliable holding.

Figure 20:
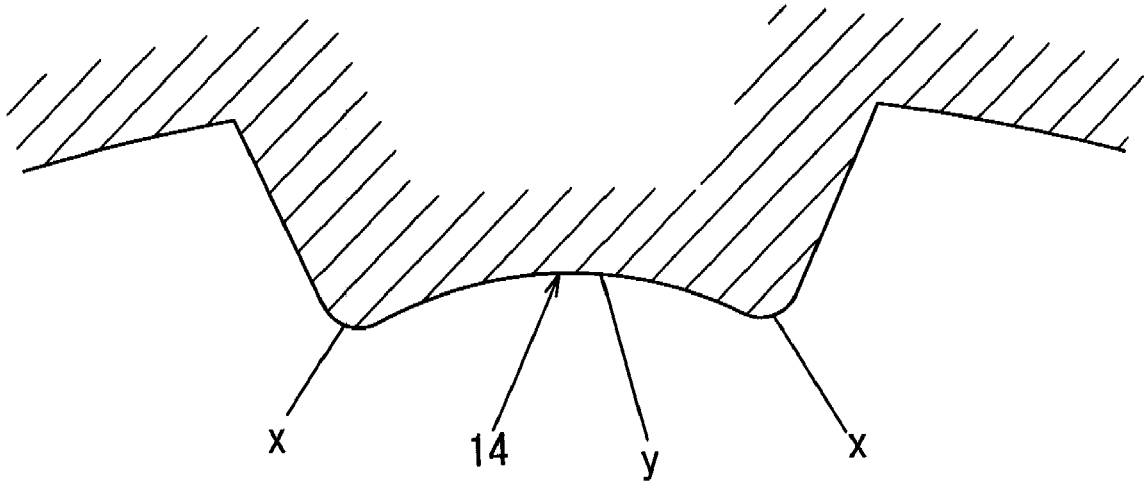
FIG. 20 is an enlarged view of a projection tip.
Figure 21:
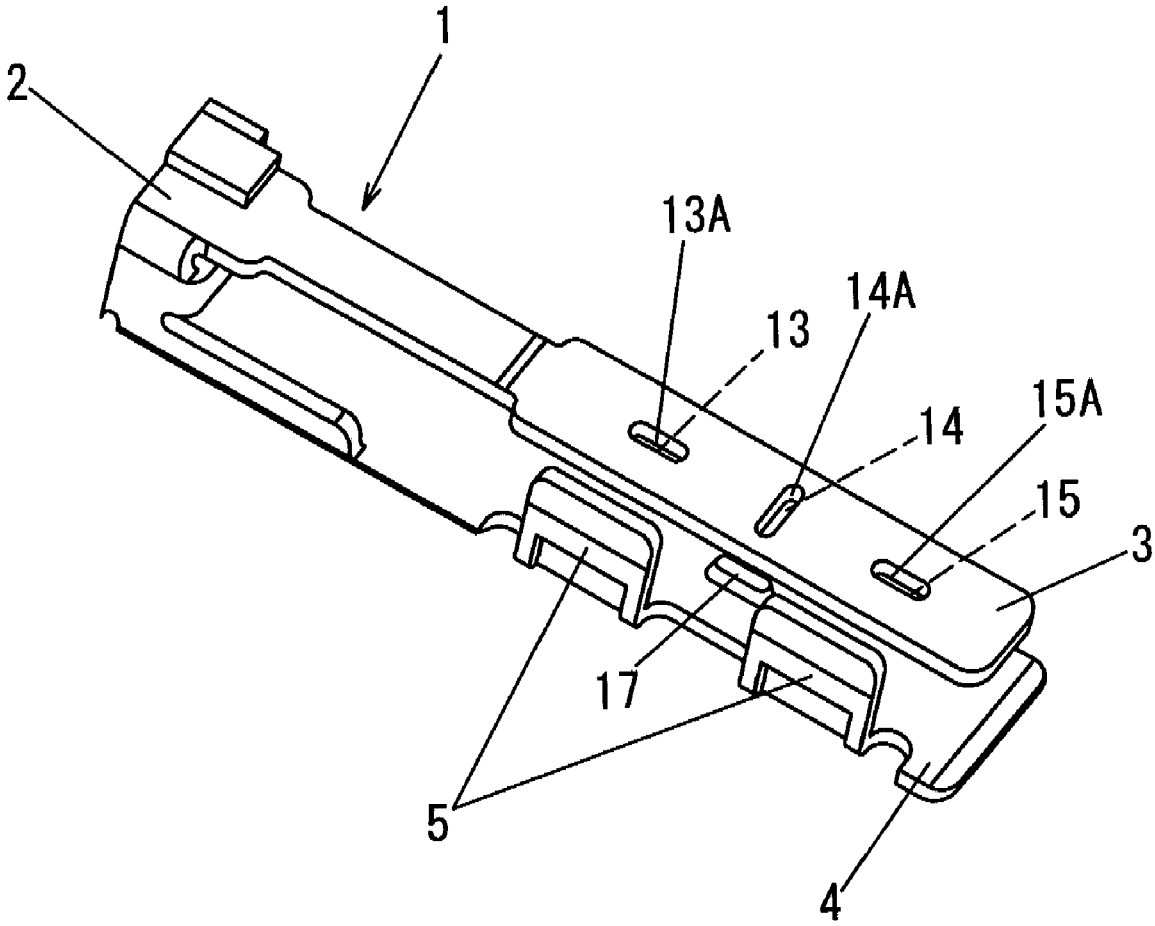
FIG. 21 is a perspective view of a terminal fitting according to a fifth exemplary embodiment.
Figure 22:
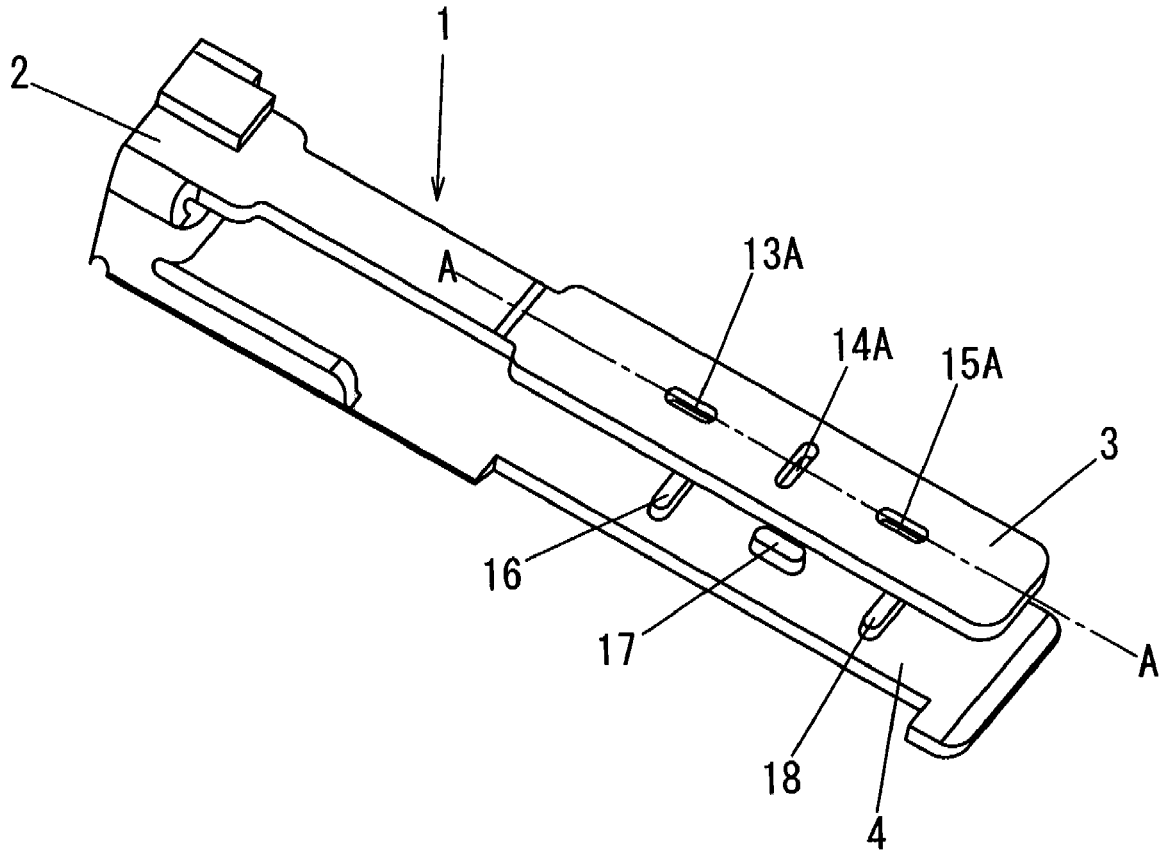
FIG. 22 is a perspective view of the terminal fitting shown in FIG. 21 with the barrels omitted.

FIG. 20 is an enlarged view of a part of the projection 14 in a pressure-contact state, and shows the state of two long sides x and an intermediate portion y in between these long sides x of the elongated projection 14. The long sides, upon being placed into pressure-contact and the intermediate portion y denting, act as edges (x), and these edges (x) are in strong-contact with the flexible substrate 10.

A terminal fitting, which is shown in FIGS. 20 to 24, according to a fifth exemplary embodiment in which an upper plate 3 and a lower plate 4, which are coupled to a tube 2 to which a male terminal or an electric wire is inserted and secured, extend in parallel with each other, barrels 5 are formed in an upstanding manner on the lower plate 4, and projections 13 to 18 are respectively formed on the mutually-facing inner surfaces of the upper plate 3 and the lower plate 4. As shown, two pairs of barrels 5, each pair consisting of two, i.e., right and left barrels, are formed. The projections 13 to 18 consist of: two (projections 13 and 15) with a shape elongated along the longitudinal direction of the upper plate 3 and one (projection 14) with a shape elongated along the widthwise direction disposed between these projections in the upper plate 3; and two (projections 16 and 18) with a shape elongated along the widthwise direction of the lower plate 4 and one (projection 17) with a shape elongated along the longitudinal direction disposed between these projections in the lower plate 4. Then, the surfaces of these projections 13 to 18 are formed to have elongated flat surfaces, and on the back sides thereof, recesses 13A to 18A are formed. These recesses 13A to 18A are formed at positions where metal plate materials are struck by means of press-molding and the projections 13 to 18 are formed at the portions that have protruded as a result of the pressing.

Figure 23:
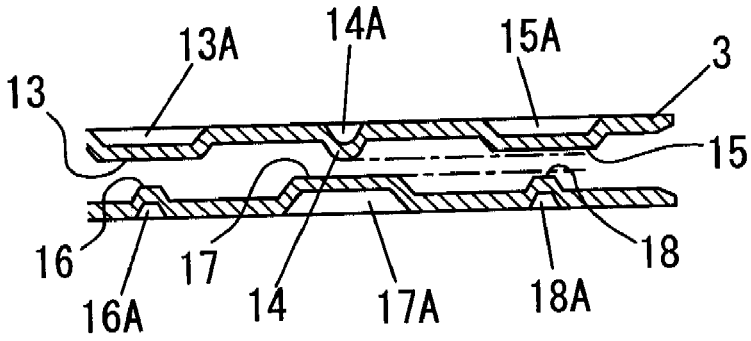
FIG. 23 is a cross-sectional view taken from line A-A of FIG. 22.

The projection 14, which is positioned in the middle of the upper plate 3 and elongated in the widthwise direction of the upper plate 3, as shown in FIG. 23, projects longer than the projections 13 and 15, which are adjacent to the projection 14 and elongated in the longitudinal direction (in FIG. 23, it projects longer downward), and the projection 17, which is positioned in the middle of the lower plate 4 and elongated in the longitudinal direction of the lower plate 4, projects longer than the projections 16 and 18, which are adjacent to the projection 17 and elongated in the widthwise direction (in FIG. 23, it projects longer upward).

Figure 24:
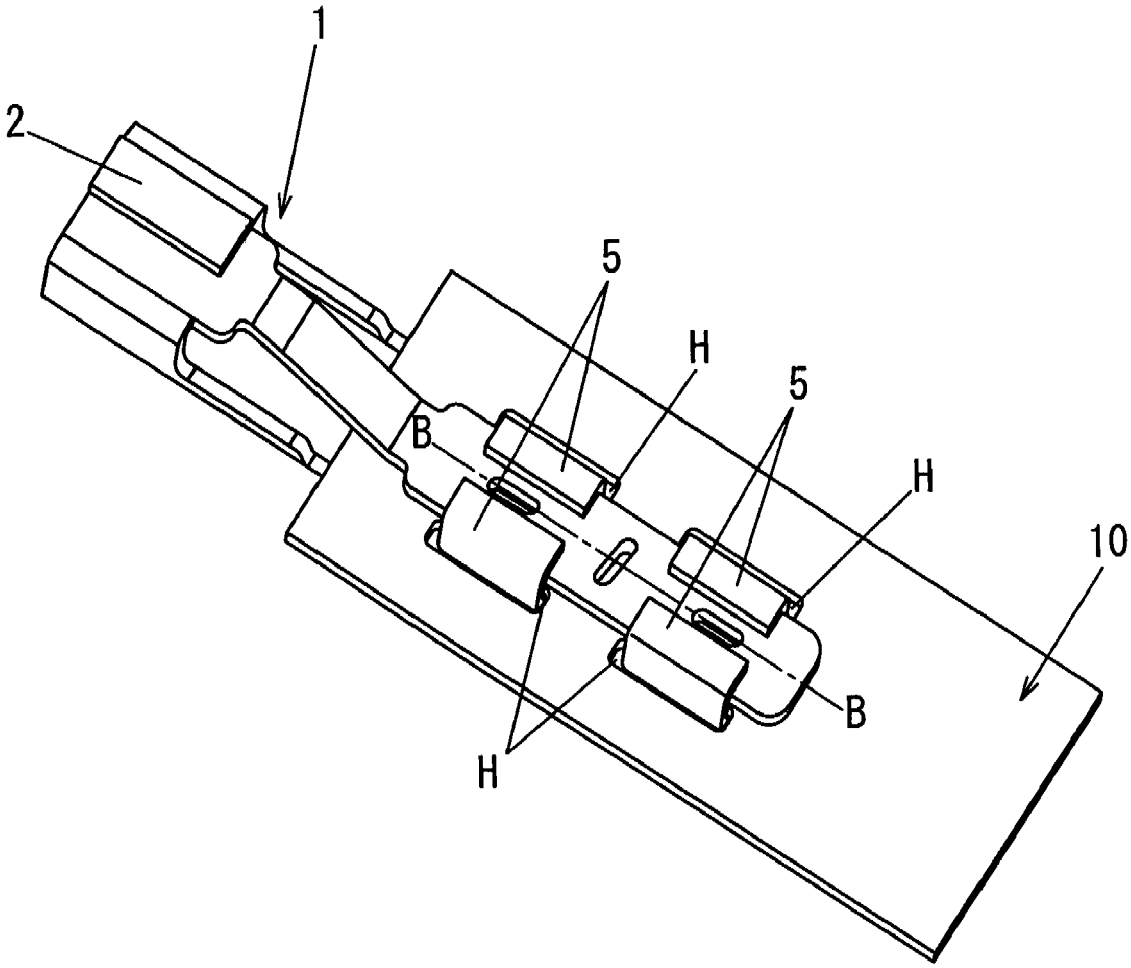
FIG. 24 is a perspective diagram showing a state of connection.

FIG. 24 shows a state in which the terminal fitting 1 is connected to a flexible substrate 10 such as an FPC, the barrels 5 formed on the lower plate 4 are inserted to holes H formed in the flexible substrate 10, and these barrels 5 are bent inward to draw the upper plate 3 toward the lower plate 4 side in such a manner that they hold the upper plate 3.

Figure 25:
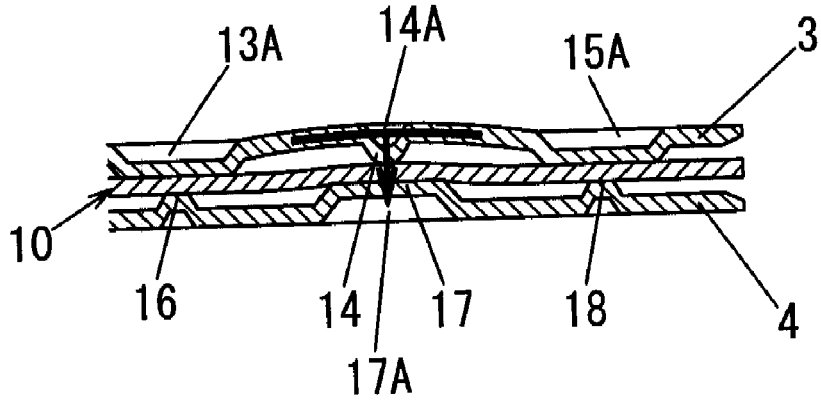
FIG. 25 is a cross-sectional view taken from line B-B of FIG. 23.

FIG. 25 is a cross-sectional view taken from line B-B of FIG. 24, and when the flexible substrate 10 is held between the upper plate 3 and the lower plate 4, the flexible substrate 10 is deformed into a wave shape by means of the projections 14 and 17 and the bottoms of the recesses 13A and 15A are strongly pressed against the flexible substrate 10, as shown in FIG. 23. The upper plate 3 bends upward as a result of the spring property of the projection 14 portion of the upper plate 3 being exerted because of the level difference between the projection 14 and the projections 13 and 15. As a result of the bending shown in FIG. 25, the pressure imposed on the flexible substrate 10 by means of the projection 14 is increased, providing reliable holding.

Figure 26:
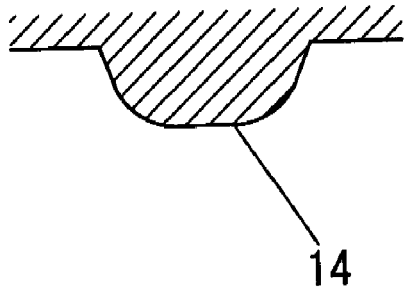
FIG. 26 is an enlarged view of a projection tip, which projects from the center of the upper plate.
Figure 27:
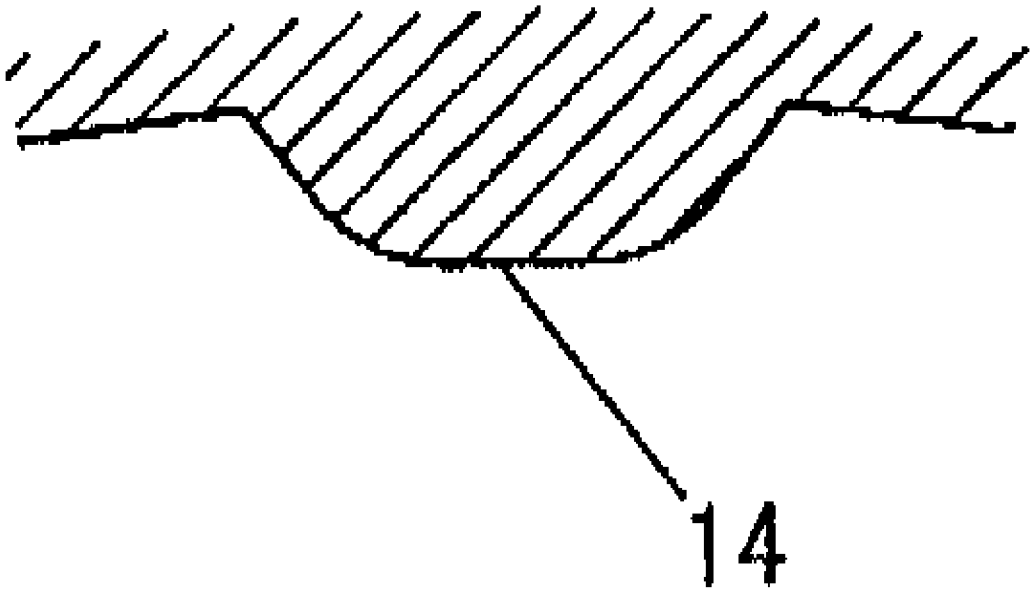
FIG. 27 shows the shape of the upper plate when the rounded surface shape comes into pressure-contact with the flexible substrate 10.

FIG. 26 is an enlarged diagram showing the shape of the surface of the projection 14 formed in the center of the upper plate 3, which projects in a shape rounded in a circular arc-like manner. FIG. 27 shows the shape when the rounded surface shape comes into pressure-contact with the flexible substrate 10: the pressure-contact portion remains rounded so that it is not in pressure contact with the flexible substrate 10, with a sharpened shape.

What is claimed is:

1. A structure for connecting a flexible substrate and a terminal fitting, the terminal fitting comprising:

an upper plate; and a lower plate;

a barrel which is formed in an upstanding manner on the lower plate, and is inserted into a hole formed in the flexible substrate, the flexible substrate being held between the upper plate and the lower plate by bending the barrel inserted to the hole;

at least one projection formed in the upper plate and at least one projection formed in the lower plate; and adjacent projections formed on both sides of one of the at least one projection formed in the upper plate and at least one projection formed in the lower plate;

wherein the at least one projection has a height greater than the adjacent projections; and wherein a part of the upper plate in which the at least one projection is formed bends away from the lower plate, and has a spring property to press the flexible substrate via the at least one projection.

2. The structure for connecting a flexible substrate and a terminal fitting according to claim 1 wherein two projections are formed in the other of the upper plate and lower plate;

one of said two projections is disposed between the projection and one of adjacent projections in one of the upper plate and the lower plate; and the other of said two projections is disposed between the projection and the other of adjacent projections in the other of the upper plate and the lower plate.

3. The structure for connecting a flexible substrate and a terminal fitting according to claim 1, wherein a reinforcing plate is provided to one surface of the flexible substrate held by terminal fitting.

4. The structure for connecting a flexible substrate and a terminal fitting according to claim 2, wherein a reinforcing plate is provided to one surface of the flexible substrate held by terminal fitting.

5. A structure for connecting a flexible substrate and a terminal fitting, the terminal fitting comprising:

an upper plate;

a lower plate;

a barrel which is formed in an upstanding manner on the lower plate, and is inserted into a hole formed in the flexible substrate, the flexible substrate being held between the upper plate and the lower plate by bending the barrel inserted to the hole;

at least one projection formed in the upper plate and at least one projection formed in the lower plate; and adjacent projections formed on both sides of one of the at least one projection formed in the upper plate and at least one projection formed in the lower plate;

wherein the at least one projection has a height greater than the adjacent projections;

wherein a part of the upper plate in which the at least one projection is formed bends away from the lower plate, and has a spring property to press the flexible substrate via the at least one projection;

wherein one of the least one projection formed in the upper plate and at least one projection formed in the lower plate is elongated in a widthwise direction of the plate;

wherein one of the at least one projection formed in other of the upper plate and lower plate is elongated in a longitudinal direction; and wherein the projection on the upper plate and the projection on the lower plate form a cross shape when they are overlapped with each other.

6. The structure for connecting a flexible substrate and a terminal fitting according to 5 comprising:

adjacent projections elongated in a longitudinal direction of the plate formed on both sides of the projection elongated in a widthwise direction of the plate;

wherein the projection elongated in a widthwise direction of the plate has a height greater than the adjacent projections elongated in a longitudinal direction of the plate.

7. The structure for connecting a flexible substrate and a terminal fitting according to claim 5, comprising:

adjacent projections elongated in a widthwise direction of the plate formed on both sides of the projection elongated in a longitudinal direction of the plate;

wherein the projection elongated in a longitudinal direction of the plate has a height greater than the adjacent projections elongated in a widthwise direction of the plate.

8. The structure for connecting a flexible substrate and a terminal fitting according to claim 5, wherein the at least one projection formed in the upper plate and at least one projection formed in the lower plate are formed such that a surface of each of the projections has an elongated flat surface.

9. The structure for connecting a flexible substrate and a terminal fitting according to claim 6, wherein the at least one projection formed in the upper plate and at least one projection formed in the lower plate are formed such that a surface of each of the projections has an elongated flat surface.

10. The structure for connecting a flexible substrate and a terminal fitting according to claim 7, wherein the at least one projection formed in the upper plate and at least one projection formed in the lower plate are formed such that a surface of each of the projections has an elongated flat surface.

11. The structure for connecting a flexible substrate and a terminal fitting according to claim 5, wherein the at least one projection formed in the upper plate and at least one projection formed in the lower plate are formed such that a surface of each of the projections are rounded in a circular arc-like manner.

12. The structure for connecting a flexible substrate and a terminal fitting according to claim 6, wherein the at least one projection formed in the upper plate and at least one projection formed in the lower plate are formed such that a surface of each of the projections are rounded in a circular arc-like manner.

13. The structure for connecting a flexible substrate and a terminal fitting according to claim 7, wherein the at least one projection formed in the upper plate and at least one projection formed in the lower plate are formed such that a surface of each of the projections are rounded in a circular arc-like manner.

14. The structure for connecting a flexible substrate and a terminal fitting according to claim 5, wherein a reinforcing plate is provided to one surface of the flexible substrate held by terminal fitting.

15. The structure for connecting a flexible substrate and a terminal fitting according to claim 6, wherein a reinforcing plate is provided to one surface of the flexible substrate held by terminal fitting.

16. The structure for connecting a flexible substrate and a terminal fitting according to claim 7, wherein a reinforcing plate is provided to one surface of the flexible substrate held by terminal fitting.

17. The structure for connecting a flexible substrate and a terminal fitting according to claim 8, wherein a reinforcing plate is provided to one surface of the flexible substrate held by terminal fitting.

18. The structure for connecting a flexible substrate and a terminal fitting according to claim 9, wherein a reinforcing plate is provided to one surface of the flexible substrate held by terminal fitting.

19. The structure for connecting a flexible substrate and a terminal fitting according to claim 10, wherein a reinforcing plate is provided to one surface of the flexible substrate held by terminal fitting.

20. The structure for connecting a flexible substrate and a terminal fitting according to claim 11, wherein a reinforcing plate is provided to one surface of the flexible substrate held by terminal fitting.

21. The structure for connecting a flexible substrate and a terminal fitting according to claim 12, wherein a reinforcing plate is provided to one surface of the flexible substrate held by terminal fitting.

22. The structure for connecting a flexible substrate and a terminal fitting according to claim 13, wherein a reinforcing plate is provided to one surface of the flexible substrate held by terminal fitting.

23. A structure for connecting a flexible substrate and a terminal fitting, the terminal fitting comprising:

an upper plate;

a lower plate;

a barrel which is formed in an upstanding manner on the lower plate, and is inserted into a hole formed in the flexible substrate, the flexible substrate being held between the upper plate and the lower plate by bending the barrel inserted to the hole;

at least one projection formed in the upper plate and at least one projection formed in the lower plate; and adjacent projections formed on both sides of one of the at least one projection formed in the upper plate and at least one projection formed in the lower plate;

wherein the at least one projection has a height greater than the adjacent projections;

wherein a part of the upper plate in which the at least one projection is formed bends away from the lower plate, and has a spring property to press the flexible substrate via the at least one projection;

wherein one of the least one projection formed in the upper plate and at least one projection formed in the lower plate is elongated in a widthwise direction of the plate;

wherein one of the at least one projection formed in other of the upper plate and lower plate is elongated in a longitudinal direction; and wherein the projection on the upper plate and the projection on the lower plate form a cross shape when they are overlapped with each other;

adjacent projections elongated in a longitudinal direction of the plate formed on both sides of the projection elongated in a widthwise direction of the plate;

wherein the projection elongated in a widthwise direction of the plate has a height greater than the adjacent projections elongated in a longitudinal direction of the plate;

adjacent projections elongated in a widthwise direction of the plate formed on both sides of the projection elongated in a longitudinal direction of the plate;

wherein the projection elongated in a longitudinal direction of the plate has a height greater than the adjacent projections elongated in a widthwise direction of the plate.

24. The structure for connecting a flexible substrate and a terminal fitting according to claim 23, wherein the at least one projection formed in the upper plate and at least one projection formed in the lower plate are formed such that a surface of each of the projections has an elongated flat surface.

25. The structure for connecting a flexible substrate and a terminal fitting according to claim 23, wherein the at least one projection formed in the upper plate and at least one projection formed in the lower plate are formed such that a surface of each of the projections are rounded in a circular arc-like manner.

26. The structure for connecting a flexible substrate and a terminal fitting according to claim 23, wherein a reinforcing plate is provided to one surface of the flexible substrate held by terminal fitting.

27. The structure for connecting a flexible substrate and a terminal fitting according to claim 24, wherein a reinforcing plate is provided to one surface of the flexible substrate held by terminal fitting.

28. The structure for connecting a flexible substrate and a terminal fitting according to claim 25, wherein a reinforcing plate is provided to one surface of the flexible substrate held by terminal fitting.

* * * * *